United States Patent [19]

Brandenburger et al.

[11] 4,103,770

[45] Aug. 1, 1978

[54] CARTON WITH TRANSVERSE PARTITION AND METHOD OF ASSEMBLING SAME

[75] Inventors: A. M. Brandenburger, Forest Park, Ill.; C. R. Helms, Collegeville, Pa.; D. F. Barker, Barrington, Ill.

[73] Assignee: Container Corporation of America, Chicago, Ill.

[21] Appl. No.: 749,749

[22] Filed: Dec. 13, 1976

[51] Int. Cl.[2] ..... B05D 75/06

[52] U.S. Cl. ..... 206/193; 229/29 R

[58] Field of Search ..... 206/193, 434, 433; 229/15, 29 B, 29 C, 29 E

[56] References Cited

U.S. PATENT DOCUMENTS

| | | | |
|---|---|---|---|
| 2,792,146 | 5/1957 | Zastrow | 206/193 |
| 2,850,207 | 9/1958 | Toensmeier | 206/193 |
| 3,662,879 | 5/1972 | Helms | 206/433 |
| 3,974,911 | 8/1976 | Graser | 206/193 |

FOREIGN PATENT DOCUMENTS

| | | | |
|---|---|---|---|
| 807,509 | 3/1969 | Canada | 206/434 |

*Primary Examiner*—Herbert F. Ross

*Attorney, Agent, or Firm*—Carpenter & Ostis

[57] ABSTRACT

A carton is provided for enclosing a pair of container groups and comprises a main panel having side panels foldably connected to side edges thereof together with at least one bottom panel foldably connected to one of the side panels, all of the panels being connected at the distal portions thereof and joined to define a tube on the erection of the panels. A partition extends transversely of the main panel and between the main panel and the bottom panel, the partition being foldably connected to the blank and movable into position upon formation of the tube to divide same into two portions whereby each portion can receive a container group by end loading into the tube.

2 Claims, 11 Drawing Figures

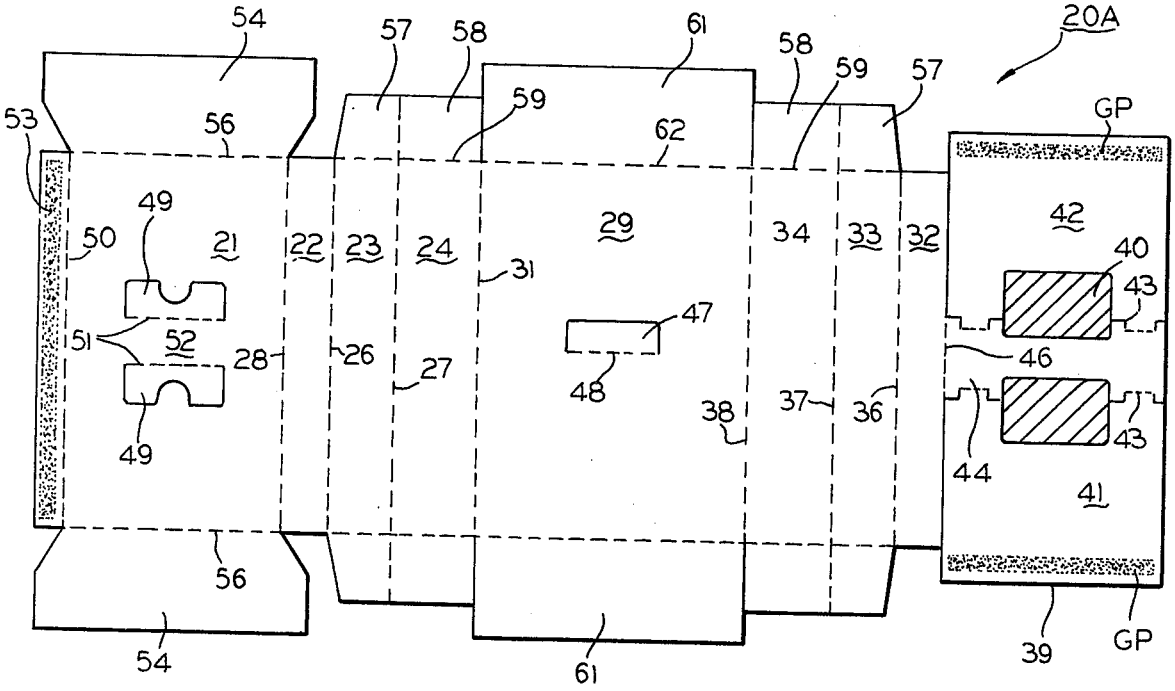
FIG.1
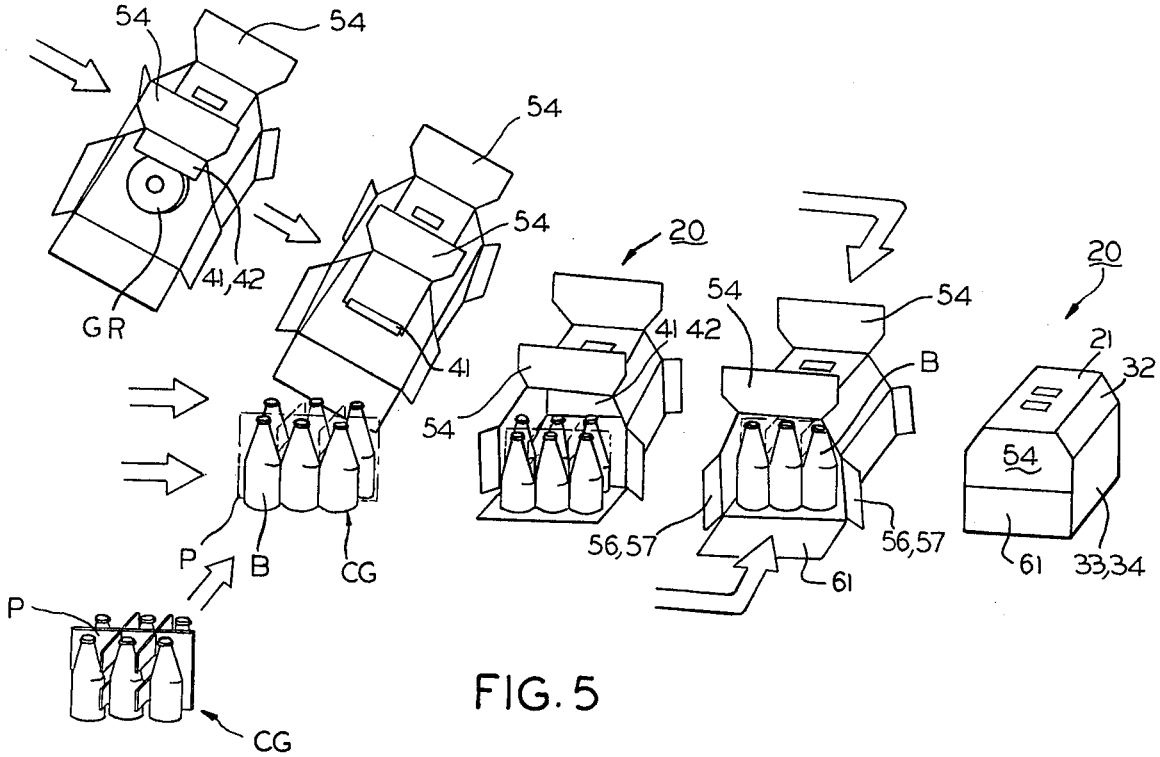
FIG. 5
FIG.5A

CARTON WITH TRANSVERSE PARTITION AND METHOD OF ASSEMBLING SAME

FIELD OF THE INVENTION

The structure according to the present invention is particularly directed to cartons constructed so as to provide a thickness of 40 pt. board between the individual containers of the group as required by Rule 41 of the Interstate Commerce Commission for glass containers. More particularly, the invention structure is directed to a retail pack for a dozen bottles employing economical spider type partitions that protect all but the center rows of contact points. The invention structure provides an integral partition providing additional strength, reduced board caliper overall, as well as a handle for carrying a dozen containers.

SUMMARY OF THE INVENTION

According to the present invention it is possible to form a carton from a single cut and scored blank and to erect same into a tube divided transversely by a double thickness of board between the compartments formed in the tube. The so erected tube is then end loaded from each side and conventional closure elements are then folded into closing position to hold the container groups in position, each of the members of a group at all times being separated by at least 40 pts. of board.

THE DRAWINGS

FIG. 1 is a plan view of a cut and scored blank for forming an improved carton according to the present invention;

FIG. 5 is a schematic view showing the manner in which the carton is erected, certain gluing operations taking place thereon, and movement of the erected carton into position to receive individual container groups in an end loading operation.

FIG. 5A is a schematic view of a container group separated by a partition and adapted to be moved into the apparatus of FIG. 5;

Figure 2:
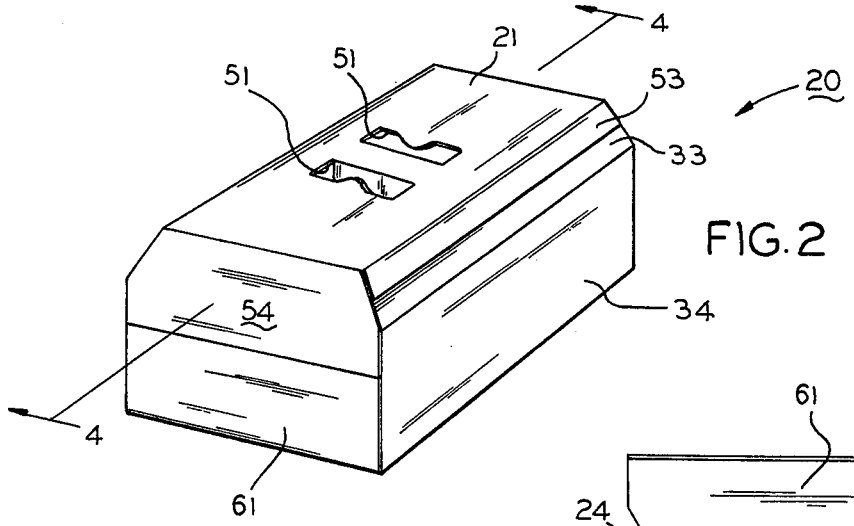
FIG. 2 is an isometric view showing the carton fully erected and closed at each end.
Figure 3:
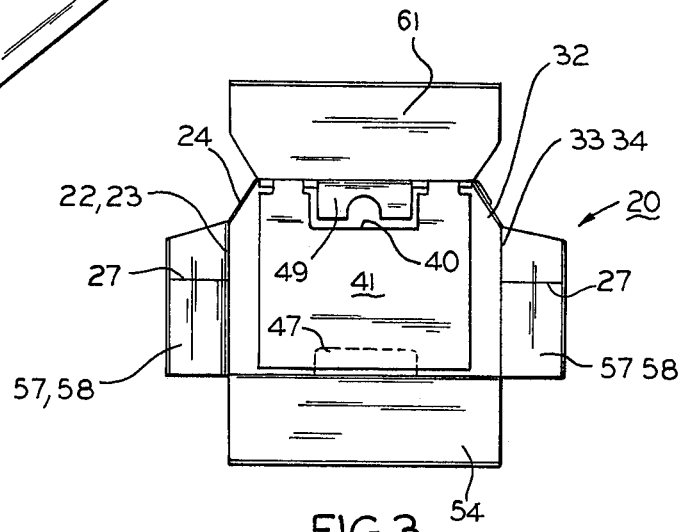
FIG. 3 is an end view showing the carton ready to be end loaded with a container group placed against an integral transverse partition therein.
Figure 4:
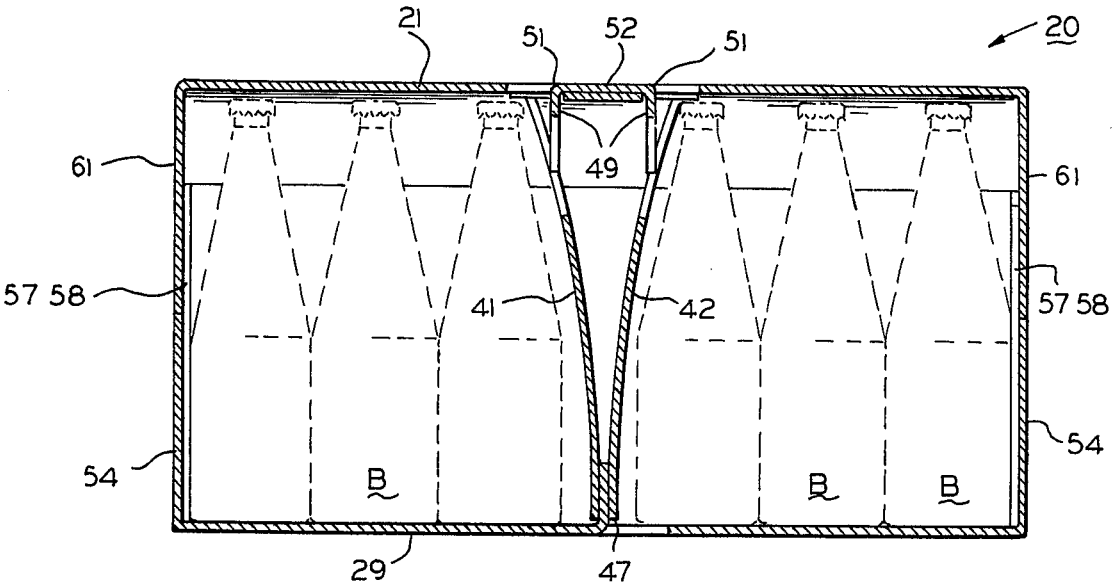
FIG. 4 is a longitudinal sectional view taken along the line 4—4 of FIG. 2 looking in the direction of the arrows.
Figure 6:
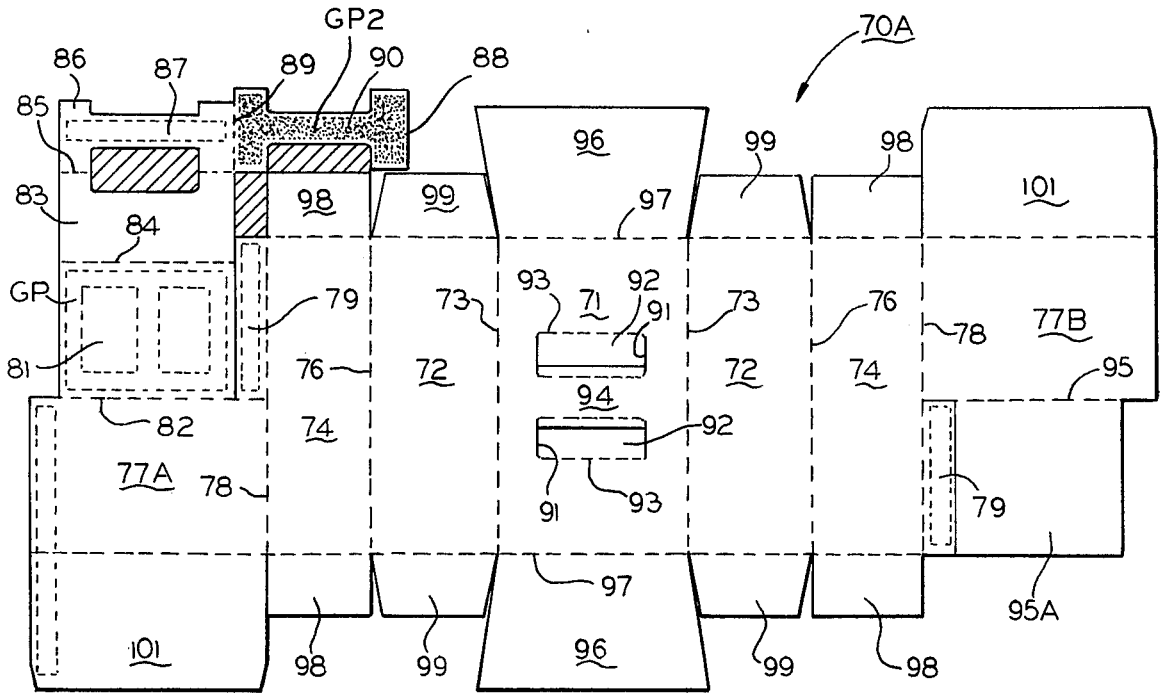
FIG. 6 is a plan view of a cut and scored blank for forming a carton according to another embodiment of the invention.
Figure 7:
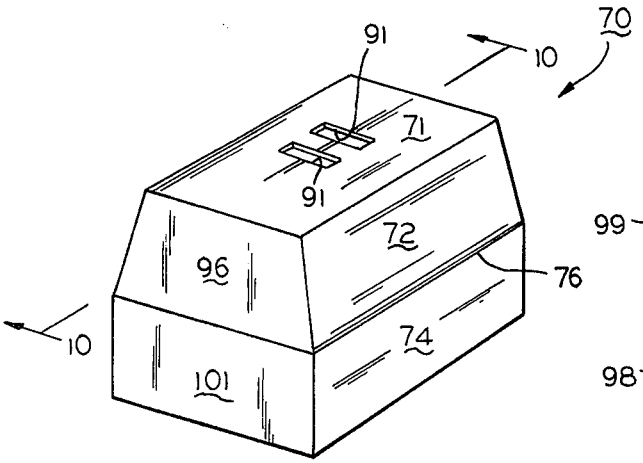
FIG. 7 is an isometric view showing the carton blank of FIG. 6 in erected position fully loaded and closed.
Figure 8:
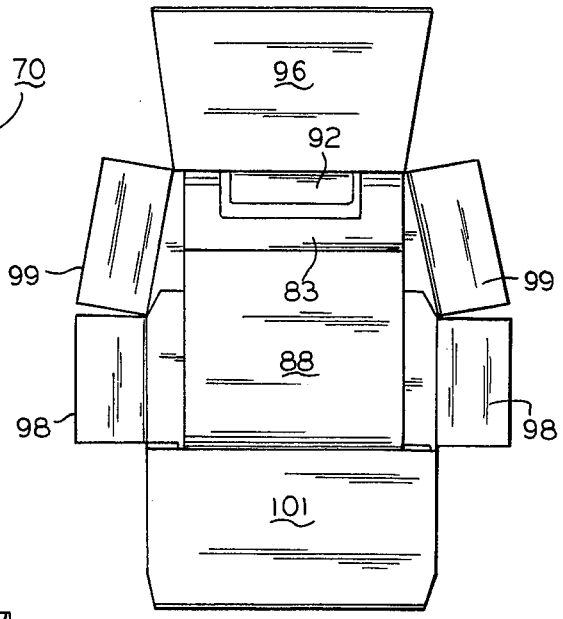
FIG. 8 is an end view of the carton prior to closing, with a transverse partition therein against which a container group moves in an end loading operation.
Figure 9:
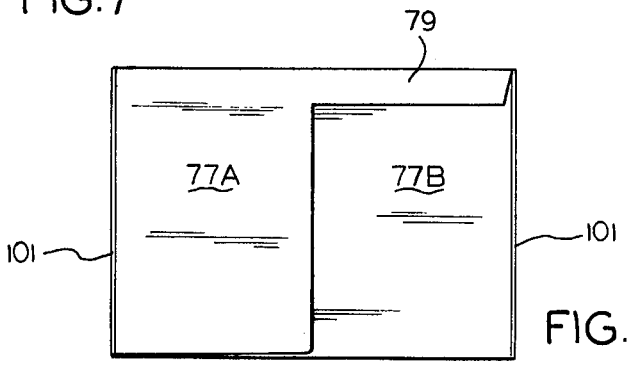
FIG. 9 is a bottom view of the erected carton.
Figure 10:
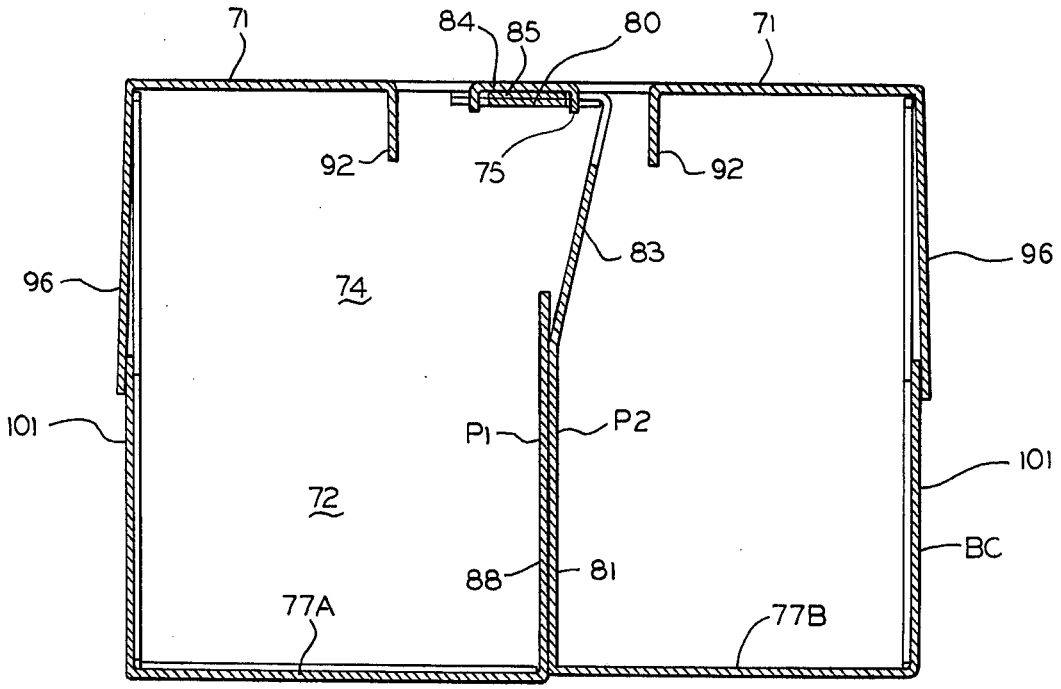
FIG. 10 is a longitudinal sectional view looking in the direction of the arrows 10—10 of FIG. 7.

Referring now to FIGS. 1 to 5 of the drawings, there is shown particularly in FIGS. 2 and 5 an improved carton denoted generally by the reference numeral 20. It is formed from a cut and scored blank 20A of paperboard or the like, consisting of a top panel 21 having a side panel portion 22, 23 and 24 extending therefrom, these being connected by fold lines 26 and 27, a side panel portion 22 being connected by a fold line 28 at one side of the main panel 21. A bottom panel 29 is connected at a fold line 31 to side panel element 24, and opposite side panel elements 32, 33 and 34 are foldably connected to a side of the bottom panel 29 along a fold line 38. Side panel elements 32, 33 and 34 are foldably connected along paralleled fold lines 36 and 37.

A transverse partition 39 is formed from partition elements 41 and 42, these being foldably connected along spaced fold lines 43 to a central web 44 connected along a fold line 46 to the side panel portion 32. Cutout portions 40 are provided in the partition elements 41 and 42.

The carton thus far described is erected first by folding the partition elements 41 and 42 about the fold lines 43, and each of the partition elements 41 and 42 is provided with a glue patch GP to contact a tab 47 in bottom panel 29 foldable to position about a score line 48. The two partition elements 41 and 42 are closed against the erected tab 47 with the web 44 spaced above the bottom panel 29.

The assembly is completed by folding the top panel 21 in position over the web 44, panel 21 being provided with a glue flap 53 connected along a score line 50 to the left side of the top panel 21, glue flap 53 being joined to the side panel element 32 at the edge thereof and against fold line 46.

It may be noted that the gluing of the partition element 41 is achieved by a glue roller GR as seen in FIG. 5, a similar structure being provided on the opposite side of the structure for gluing partition element 42.

As the erected carbon 20 moves to position as an open ended tube, container groups CG of bottles B each separated by partition P are moved as seen by the arrows in FIG. 5 into the open ends of the tube thus far described.

Partition P is preferably constructed as seen in patents to Helms U.S. Pat. Nos. 3,662,879 and 3,743,163, such dividers providing proper board thickness between adjacent bottles with a minimum amount of board.

The top panel 21 is provided at each end with closure flaps 54 connected thereto at score lines 56, and the side panel portions 23, 24, and 33 and 34 are provided with closure flaps 57 and 58 folded to position at score lines 59. Bottom panel 29 is likewise provided at each end with closure flaps 61 for closing of the ends of the filled container tube.

The top panel 21 has a pair of hand receiving openings or holes partly closed by flaps 49 folded down along the score lines 51 and defining a carrying strap or handle 52 between said score lines 51.

Referring now to FIGS. 6 to 10 of the drawings, there is shown another embodiment of the invention characterized by being formed from a cut and scored blank which is assembled as a flattened carton tube capable of being erected by conventional machinery with transverse partition elements therein moving into erected position as the carton tube is erected, the carton tube then being ready for end loading as has been provious ly described with respect to the former embodiment.

In this latter embodiment of the invention the carton is denoted generally by the reference numeral 70 and is formed from a cut and scored blank 70A comprised of a central top panel 71 flanked by side panel elements 72 and 74, panel element 72 being foldably connected along a fold line 73 to top panel 71, and side panel element 74 being foldably connected to side panel element 72 along a fold line 76.

One of the side panel elements 74 is connected by a score line 78 to a half bottom panel 77A, while the other side panel element 74 is foldably connected at the other score line 78 to a half bottom panel 77B.

Each of the side panel elements 74 is connected to a glue flap 79, each hingedly connected to the side panel elements 74 along the fold line 78.

Half bottom panel 77A is connected by a score line 82 to a transverse partition element 81, while half bottom panel 77B is connected by a score line 95 to a second transverse partition element 95A. The two transverse partition elements 81 and 95A, being brought into facing relationship and secured together by a glue patch GP on transverse partition element 81.

Transverse partition element 81 is connected by a fold line 84 to a hinging partition element 83, and a handle reinforcing element 86 is foldably connected thereto along a score line 85, there being a web 87 in the reinforcing element 86. A second handle reinforcing element 88 is foldably connected to reinforcing element 87 along fold line 89, and web 90 of element overlaps web 87, the two webs being joined by glue patch GP2.

Top panel 71 is provided with a pair of hand holes 91, these being partly closed by flaps 92 folded down along scored lines 93, there being a web 94 between the two hand holes 91.

The sequence for folding the elements comprising the blank 70A to provide a flattened tube capable of being erected with the transverse partition elements 81 and 82 erected at the same time is as follows:

Reinforcing element 88 is folded about the score line 89 against reinforcing element 86 with the webs 87 and 90 in register and glued together. Panel element 83 is then folded about score line 84 and then half bottom 77A and side panel 74 are folded about score line 76 until webs 87 and 90 are in register with the web 94 between the hand holes 91 and glued thereto.

Transverse partition element 95A is then folded about score line 95 into facing relationship with half bottom panel 77B and then folded about score line 76 until transverse partition element 95A falls into register with transverse partition element 81 which has been heretofore folded into position about its adjacent fold line 76, transverse partition element 81 having a glue patch GP thereon as shown.

The carton thus far described is now in the form of the flattened tube ready to be erected with the transverse partition elements 81 and 95A lying flat between half bottom panel 77B and top panel 71 with the panel element 83 acting as a hinge connected to top panel 71. As the flattened and glued blank is erected into a tube, partition elements 81 and 95A move to erected position, each being hinged to respective bottom panels 77A and 77B.

After the end loading is completed as seen with respect to FIG. 5 of the other embodiment, the ends of the loaded carton are closed, top panel 71 having closure flaps 96 at each end thereof connected thereto at fold lines 97, side panel elements 72 and 74 likewise have closure flaps 98 and 99 foldable with respect thereto along the same fold line.

Half bottom panels 77A and 77B are likewise provided with end closure flaps 101 also foldable to the closing position along fold line 97. All of the closure flaps can be held together in any convenient fashion as by glueing or heat sealing.

We claim:

1. A paperboard blank cut and scored to form a carton for enclosing a pair of article groups, each blank comprising:

(a) a top forming panel and a bottom forming panel;
(b) a pair of side forming panels foldably connected to opposite side edges of said bottom forming panel;
(c) one of said side forming panels being foldably connected to an edge of said top forming panel;
(d) said side forming panels being formed from a plurality of hingedly interconnected panel elements to give truncated appearance to the carton when erected;
(e) a web element hinged to the other of said side forming panels along a fold line;
(f) a pair of partition forming elements foldably secured to opposite edges of said web element along hinge lines disposed in normal relationship to said fold line.

2. A paperboard carton for enclosing a pair of article groups, said carton being formed from a blank defined in claim 1.

* * * * *